US007041173B2

(12) United States Patent
Merabet

(10) Patent No.: US 7,041,173 B2
(45) Date of Patent: May 9, 2006

(54) SPRAYING BOWL, SPRAYING DEVICE INCORPORATING SUCH A BOWL AND SPRAYING INSTALLATION INCORPORATING SUCH A DEVICE

(75) Inventor: Djamel Merabet, Eybens (FR)

(73) Assignee: Sames Technologies, Meylan (FR)

( * ) Notice: Subject to any disclaimer, the term of this patent is extended or adjusted under 35 U.S.C. 154(b) by 0 days.

(21) Appl. No.: 10/661,776

(22) Filed: Sep. 15, 2003

(65) Prior Publication Data

US 2004/0140378 A1 Jul. 22, 2004

Related U.S. Application Data

(60) Provisional application No. 60/410,281, filed on Sep. 13, 2002.

(30) Foreign Application Priority Data

Mar. 27, 2003 (FR) ..... 03 03783

(51) Int. Cl.
*B05B 3/00* (2006.01)
*F23D 11/04* (2006.01)

(52) U.S. Cl. ..... 118/323; 118/300; 239/224; 239/223; 239/220

(58) Field of Classification Search ..... 239/223–224, 239/220, 381, 394, DIG. 11; 118/300, 323, 118/321

See application file for complete search history.

(56) References Cited

U.S. PATENT DOCUMENTS

| | | | | |
|---|---|---|---|---|
| 4,023,057 | A * | 5/1977 | Meckling | 310/154.07 |
| 4,473,188 | A | 9/1984 | Ballu | |
| 2001/0015386 | A1 | 8/2001 | Pruss | |

FOREIGN PATENT DOCUMENTS

| | | |
|---|---|---|
| WO | WO 94/12286 | 6/1994 |
| WO | WO 01/62396 | 8/2001 |

OTHER PUBLICATIONS

William F. Smith, Principles of Materials Science and Engineering, 1931 p. 611.*

Voss, Christoph "Solenoid Valve, in Particular for Slip-Controlled Motor Vehicle Braking Systems" (First Page of WO 01/66396 A1), Sep. 13, 2001.

* cited by examiner

*Primary Examiner*—Chris Fiorilla
*Assistant Examiner*—Yewebdar Tadesse
(74) *Attorney, Agent, or Firm*—Browdy and Neimark, PLLC

(57) ABSTRACT

The bowl according to the invention is provided with magnetic elements disposed around a male part which is adapted to be engaged in a central channel of a drive member, the magnetic elements forming outer radial flanges with respect to this male part.

In the spraying device, the bowl is associated with a drive rotor, magnetic coupling means being provided which comprise magnetic bodies disposed on either side of at least one magnet borne by the rotor, while the bowl bears ribs formed in a magnetic material.

The effort of magnetic coupling obtained has a radial component with respect to the axis of rotation of the bowl.

22 Claims, 7 Drawing Sheets

SPRAYING BOWL, SPRAYING DEVICE INCORPORATING SUCH A BOWL AND SPRAYING INSTALLATION INCORPORATING SUCH A DEVICE

This application claims the benefit of Provisional Application No. 60/410,281, filed Sep. 13, 2002.

FIELD OF THE INVENTION

The present invention relates to a spraying bowl for a rotary sprayer for projecting coating product. The invention also relates to a device for spraying coating product comprising such a bowl, as well as to an installation for spraying coating product incorporating such a device.

BACKGROUND OF THE INVENTION

In a coating product spraying installation, it is known to spray the product by means of a rotary element called a bowl or dish, supplied with product and rotating at a speed included between 2,000 and 100,000 rpm. At the speeds in question, the bowl must be as light and balanced as possible in order to avoid unbalance to a maximum, particularly if its drive means comprise an air and/or magnetic bearing turbine.

It is known, for example from WO-A-94/12286, to connect a bowl to a rotor by means of a fitting ring capable of radial expansion. It is also known, for is example from WO-A-01/62396 or from U.S. Pat. No. 4,473,188, to use magnetic coupling means between a bowl and the rotor of a turbine. In these devices, the effort to be exerted in order to uncouple the bowl from the rotor must be intense. As soon as these elements are separated, the effort of magnetic coupling decreases very considerably, with the result that nothing opposes the movement of tearing-away of the bowl. This results in a risk of a bowl escaping the operator during its dismantling, as the resistant effort of the magnetic coupling drops very rapidly as soon as the bowl is separated from the rotor.

Now, if such a bowl falls, its spraying edge is generally damaged, this degrading the quality of the spray obtained. In other words, when a bowl falls on the ground, it is not rare to have to replace it, while such equipment is expensive in view of the care taken to manufacture it. Known devices comprise one or more magnets constituting together an annular magnetization device. This involves this or these magnets being sufficiently voluminous to generate an intense magnetic field, which is detrimental to the compactness of the sprayer. In addition, the weight and inertia of the bowl are relatively great, more particularly in the case of the bowl bearing the permanent magnet or magnets. Finally, the magnets must be subjected to a particular mechanical assembly in order not to risk bursting under the effect of the centrifugal efforts.

It is a more particular object of the present invention to overcome these drawbacks by proposing a spraying bowl which may be easily driven by a rotor provided to that end, thanks to an efficient magnetic coupling, while allowing an easy assembly and dismantling of the bowl, at the beginning and end of service.

SUMMARY OF THE INVENTION

In that spirit, the present invention relates to a spraying bowl for a rotary sprayer projecting coating product, this bowl being equipped with means for magnetic coupling with a member for driving in rotation or with a casing surrounding this member, characterized in that these magnetic coupling means are adapted to cooperate with complementary means borne by the drive member or by the casing, in such a manner that the magnetic coupling effort obtained has a radial component with respect to the axis of rotation of this bowl.

Thanks to the invention, the effort of the magnetic coupling obtained is efficient, while the coupling means provided on the bowl participate in the magnetic coupling between the bowl and the drive member or casing, including during the movements of positioning or dismantling of the bowl with respect to the sprayer. This renders the effort having to be overcome or accompanied by the operator on that occasion, satisfactorily progressive.

In addition, a spraying bowl for sprayer may incorporate one or more of the characteristics of one of claims 2 to 8.

This invention also relates to a device for spraying coating product, which comprises a bowl and a member adapted to drive this bowl, magnetic coupling means including at least one permanent magnet being provided between the bowl and the afore-mentioned member or between the bowl and a casing surrounding this member. This device is characterized in that the coupling means are disposed so that the magnetic coupling effort has a radial component with respect to the axis of rotation of the bowl.

These magnetic coupling means advantageously further comprise at least one magnetic body associated with the magnet and mounted on one of the two elements composed of the bowl and the drive member or the bowl and the casing, while the other element bears at least one rib formed in a magnetic material. In such a device, the ribs constitute the induced poles of a magnetic coupling device of which the magnetic bodies associated with the magnets form the inductor poles.

The thickness of the or each rib is advantageously substantially equal to the thickness of the magnetic bodies. Similarly, when the device comprises a plurality of magnetic bodies and a plurality of ribs, the relative spacing of these ribs is advantageously substantially equal to or corresponds substantially to a multiple or a sub-multiple of the relative difference of magnetic effort. The positioning and geometry of these ribs are thus adapted as a function of the positioning and the geometry of the polar masses constituted by the magnetic bodies, in order to optimalize the desired coupling effort. These ribs allow a concentration of the electromagnetic field at their level, hence an improvement of the magnetic coupling obtained.

Furthermore, a sprayer device may incorporate the characteristics of one of claims 13 to 21.

Finally, this invention relates to an installation for spraying coating product, which comprises at least one spraying device as described hereinabove.

BRIEF DESCRIPTION OF THE DRAWINGS

The invention will be more readily understood and other advantages thereof will appear more clearly in the light of the following description of five forms of embodiment of a device for spraying coating product incorporating a bowl according to the invention, given solely by way of example and made with reference to the accompanying drawings, in which.

DESCRIPTION OF PREFERRED EMBODIMENTS

Figure 1:
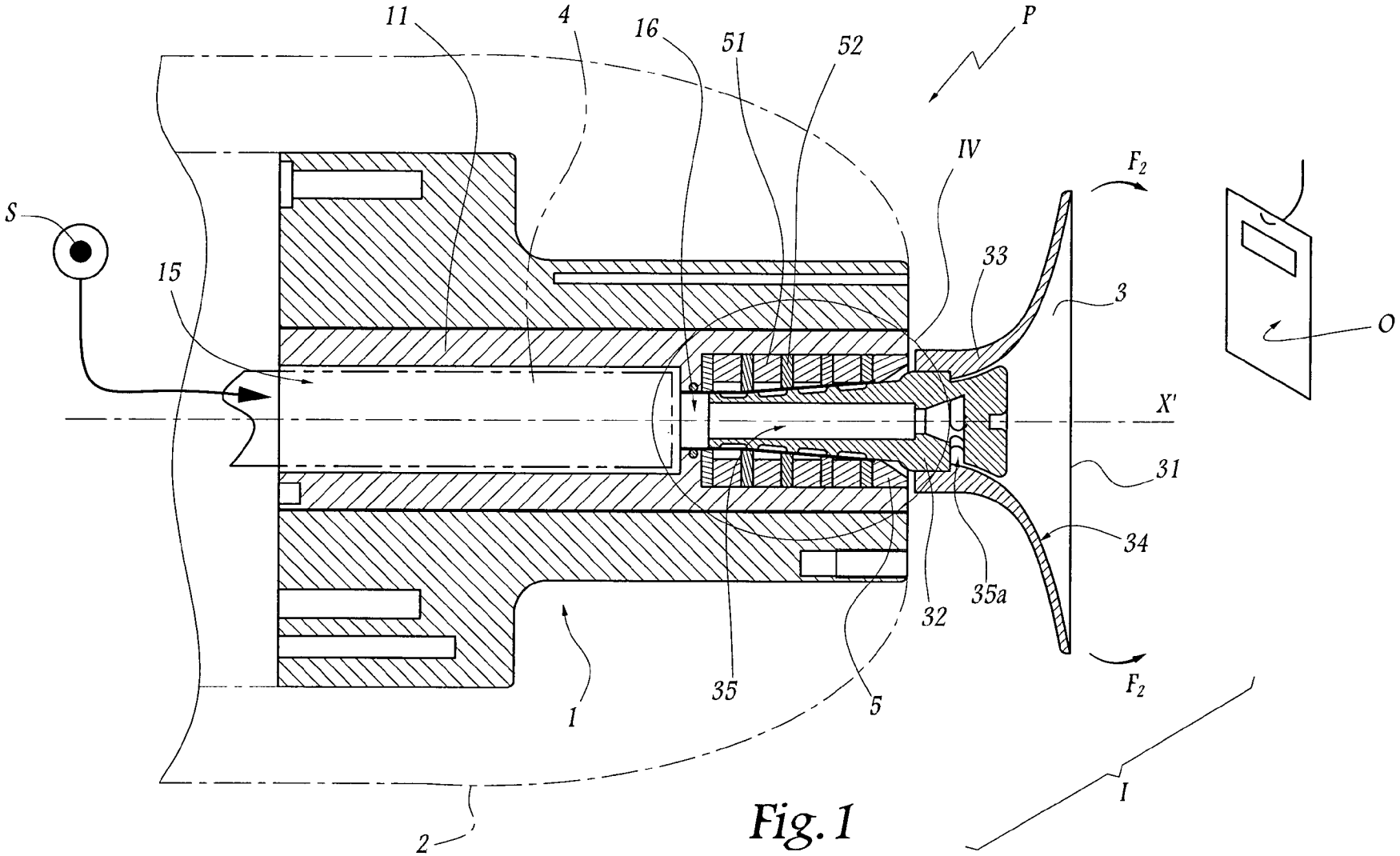
FIG. 1 is a longitudinal section through a coating product sprayer in accordance with a first form of embodiment of the invention, incorporating a bowl in accordance with a first form of embodiment and forming part of an installation according to the invention.
Figure 2:
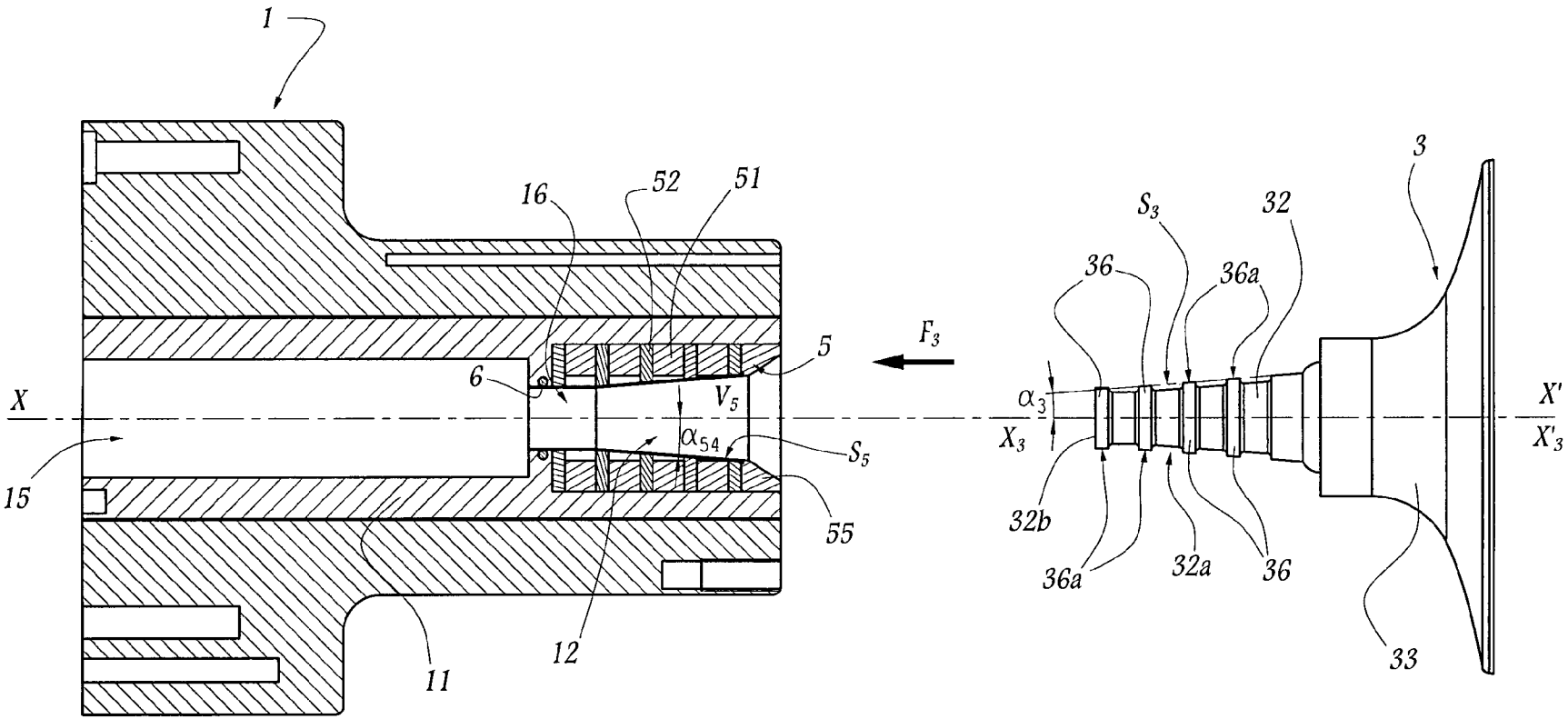
FIG. 2 is a longitudinal section through the rotor and a side view of the bowl of the device of FIG. 1.
Figure 3:
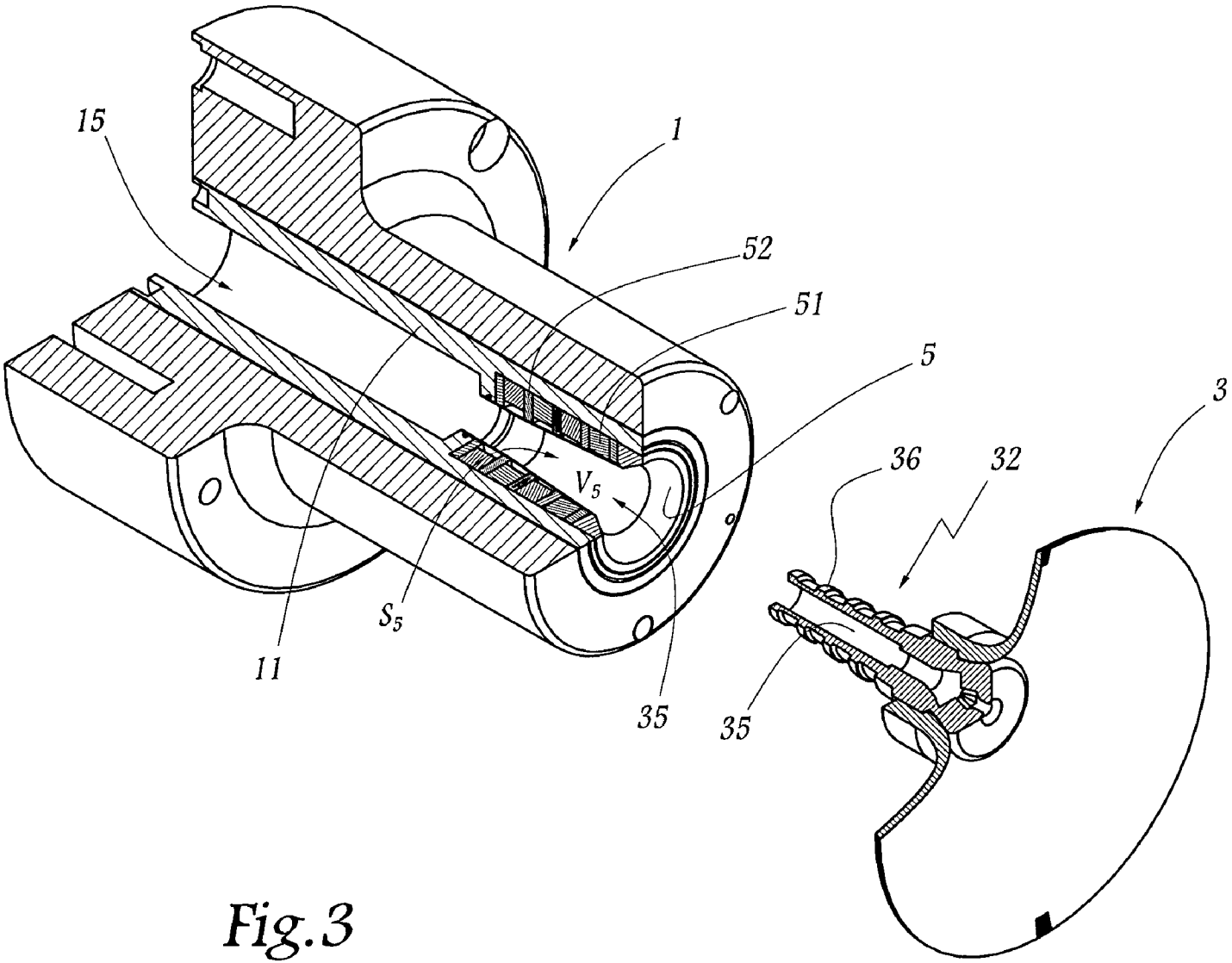
FIG. 3 is a view in perspective with parts torn away of the elements shown in FIG. 2.

Referring now to the drawings, the spraying device or sprayer P shown in FIGS. 1 to 4 is intended to be supplied with coating product from one or more sources S and displaced; for example with an essentially vertical movement represented by the double arrow $F_1$, opposite objects O to be coated, inside an installation I for coating these objects. The sprayer P comprises a turbine of which only the central part 1 is shown, which includes a rotor 11 and which is surrounded by a protective cowling 2. A bowl 3 is intended to be mounted on the rotor 11 and set in rotation thereby, about an axis X–X', at a speed of several tens of thousands of revolutions per minute, for example 80,000 rpm, with the result that the coating product coming from the source S is sprayed in the direction of an object O, as represented by arrows $F_2$.

According to an advantageous aspect of the invention which has not been shown, the sprayer P may be of electrostatic type, i.e. may comprise means for electrostatically charging the coating product before or after it has been discharged from the edge 31 of the bowl 3.

The bowl 3 is formed by two parts, namely a hub 32 and a part 33 forming dish which defines a surface 34 for flow and distribution of the coating product in the direction of the edge 31. The hub 32 is hollow and defines a longitudinal channel 35 centered on an axis $X_3$–$X'_3$ which is merged with the axis X–X' when the bowl 3 is mounted on the rotor 1.

This channel 35 communicates via radial openings 35*a* with the surface 34.

The hub 32 constitutes a male part of the bowl 3 which is intended to be introduced in a housing 12 of the rotor 11 centered on the axis X–X' and which extends a channel 15 for supplying the bowl 3 with coating product. A pipette 4 for injection may be provided in the channel 15 as shown, solely in dashed and dotted lines, in FIG. 1.

The channel 15 communicates with the housing 12 through a zone 16 of reduced diameter.

Inside the housing 12 there is disposed a cartridge 5 comprising four annular magnets 51 of parallelepipedic section and five magnetic bodies 52 interposed between two adjacent magnets 51 and disposed on either side of the outer magnets. The bodies 52 may be made of any appropriate material, for example of steel.

All the magnets 51 have substantially the same width $\mathbf{1}_{51}$ taken in a radial direction with respect to the axis X–X'. On the other hand, the magnetic bodies 52 have a width $\mathbf{1}_{52}$ measured in the same direction, which increases from the side 53 of the cartridge 5 facing the outside of the rotor 2, towards the conduit 15.

A tight and a magnetic partition 54 is disposed in abutment on the edges 52*a* of the bodies 52 projecting with respect to the magnets 51 in the direction of the axis X–X', this partition making it possible to protect the magnets 51 from mechanical and chemical aggressions.

The partition 54 comprises a first part $\mathbf{54}_1$ which is cylindrical with circular base and centered on axis X–X' and a second part $\mathbf{54}_2$ which is truncated and divergent in the direction of the side 53 of the cartridge 5, i.e. in the direction of the opening 12*a* of the housing 12 facing the outside of the rotor 1.

The part $\mathbf{54}_2$ of the partition 54 is extended by the inner radial surface $\mathbf{55}_1$ of a shim 55, the opening half-angle $\alpha_{55}$ of the truncated surface $\mathbf{55}_1$ being greater than the opening half-angle $\alpha$54 of the inner surface of the part $\mathbf{54}_2$.

The edges 52*a* of the bodies 52 which project with respect to the elements 51 are bevelled in order to follow the shape of the outer surface of the partition 54.

In its central part, the cartridge 5 defines a volume $V_5$ for receiving the hub 32 of the bowl 3. This volume $V_5$ is defined by the inner surface of the part $\mathbf{54}_2$ which corresponds to a geometrical surface $S_5$ which is truncated and with vertex half-angle $\alpha_{54}$.

The outer radial surface 32*a* of the hub 32 is provided with four ribs 36 which are in one piece with the hub 32, itself made of a magnetic material such as steel. These ribs form outer radial flanges with respect to the hub 32 and, with the exception of the rib 36 nearest the free end 32*b* of the hub 32, have respective outer radial surfaces which are truncated and inscribed in a geometrical surface $S_3$ centered on the longitudinal axis $X_3$–$X'_3$, convergent in the direction of the free end 32*b* of the part 32 and with vertex half-angle $\alpha_3$. The value of the half-angle $\alpha_3$ is chosen to be equal to the value of the half-angle $\alpha_{54}$.

In this way, when the bowl 3 is being positioned on the rotor 1 and after the axes X–X' and $X_3$–$X'_3$ have been aligned, it is possible to cause the surfaces $S_3$ and $S_5$ to merge, this allowing a surface bearing of the outer radial surfaces 36*a* of the majority of the ribs or flanges 36 on the partition 54.

Figure 4A:
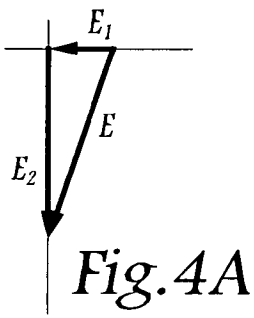
FIG. 4A is a vectorial representation of the effort of magnetic coupling in the configuration of FIG. 4.
Figure 4:
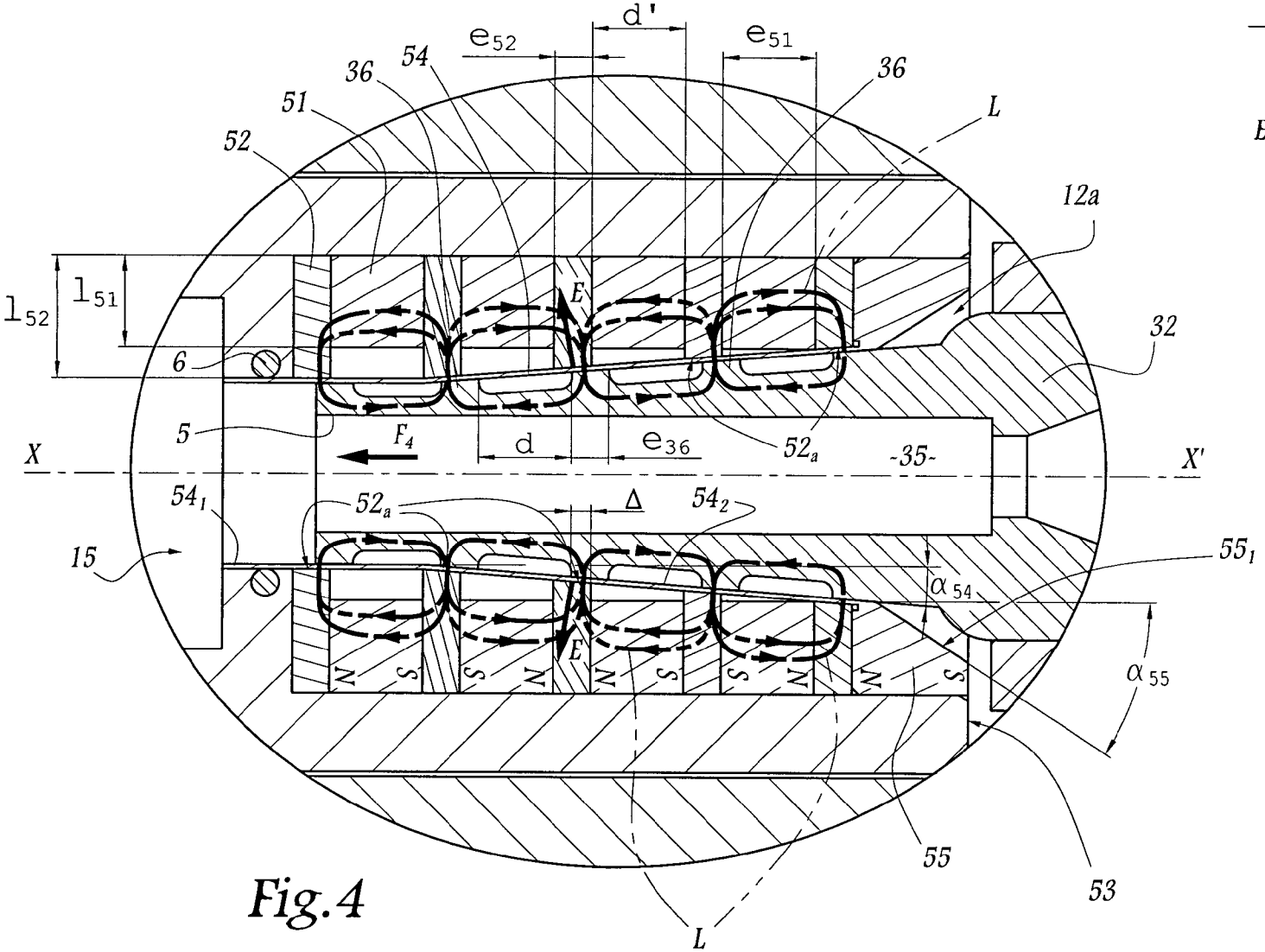
FIG. 4 is a view on a larger scale of detail IV in FIG. 1.

The position of FIGS. 1 and 4 is then attained, where the lines L of magnetic field due to the magnets 51 reclose through the elements 52 and 36, also passing in the principal parts of the elements 51 and 32.

In this configuration, the effort E of magnetic coupling obtained, when the bowl is mounted on the rotor 11 and ready to rotate, has an axial component $E_1$ which is non-zero and parallel to the axis X–X' of rotation of the bowl 3 and a component $E_2$ which is radial with respect to this axis and likewise non-zero. This effort is exerted between the elements 52 and 36, through the partition 54.

In practice, the component $E_2$ has an intensity greater than that of the component $E_1$, which is to be compared with the value of the half-angle $\alpha_{54}$ and with the relative position of the elements 52 and 36 when the bowl 3 is in mounted configuration.

In order to amplify this phenomenon of magnetic coupling, the thickness $e_{36}$ of the ribs 36 taken parallel to the axis $X_3$–$X'_3$ is substantially equal to the thickness $e_{52}$ of the magnetic bodies 52, while the spacing d between the ribs 36 is substantially equal to the spacing d' of two bodies 52, i.e. to the thickness $e_{51}$ of a magnet 51 taken parallel to axis X–X'.

The magnets 51 are identical to one another, while the bodies 52 all have the same thickness, their width taken perpendicularly to axis X–X' being variable as explained hereinabove.

With the foregoing in mind, the circumferential ribs or flanges 36 participate in the closure of the magnetic field created by the magnets 51 and which propagates through the magnetic bodies 52.

In FIG. 4 is noted a slight offset Δ along the axis X–X' between the ribs 36 and the bodies 52. This offset has the effect of exerting on the hub 32 an effort $F_4$ due to the component $E_1$ of the magnetic effort E directed towards the upstream of the conduit 15, which has the effect of firmly applying the hub 32 inside the cartridge 5 and of thus immobilizing the bowl 3 with respect to the rotor 1.

When the bowl 3 is dismantled with respect to the rest of the sprayer P, the offset Δ is increased and the effort of magnetic coupling decreases progressively, which avoids the sudden movements and the risks of the bowl 3 escaping the operator. In that case, the relative values of the components $E_1$ and $E_2$ may vary with respect to each other.

In the example shown, the ribs 36 are made by superficial machining of the surface 32*a* of the hub 32. According to a variant embodiment of the invention (not shown), these ribs or flanges might be formed by rings added on the hub 32.

In this first form of embodiment, the bowl does not present magnets, which renders it particularly attractive from the standpoint of economics.

An O-ring 6 is mounted in the zone 16 of reduced diameter and receives in abutment the part $\mathbf{54}_1$ of the partition 54, which makes it possible to isolate even more perfectly the compartment of the cartridge 5 which encloses the magnets with respect to the volume for passage of the coating and/or cleaning products.

In a variant, the partition 54 is not necessarily extended up to the level of the zone 16, in which case the O-ring 6 comes into abutment against the end part of the hub 32. In that case, the zone 16 may be provided to be slightly conical in order to facilitate assembly.

According to a variant of the invention (not shown), radial ribbings, of the gear teeth type, may be machined or added on the inner radial surface of the cartridge 5 and on the hub 32, in order to ensure hold of the bowl and in particular to limit the radial and/or tangential slide thereof with respect to the magnets, during transitory speeds of acceleration or of deceleration. In that case, it is necessary to provide an axial and radial clearance for the assembly with these ribbings, so as to conserve a satisfactory centering of the conical part of the edge with respect to the magnets.

Figure 5:
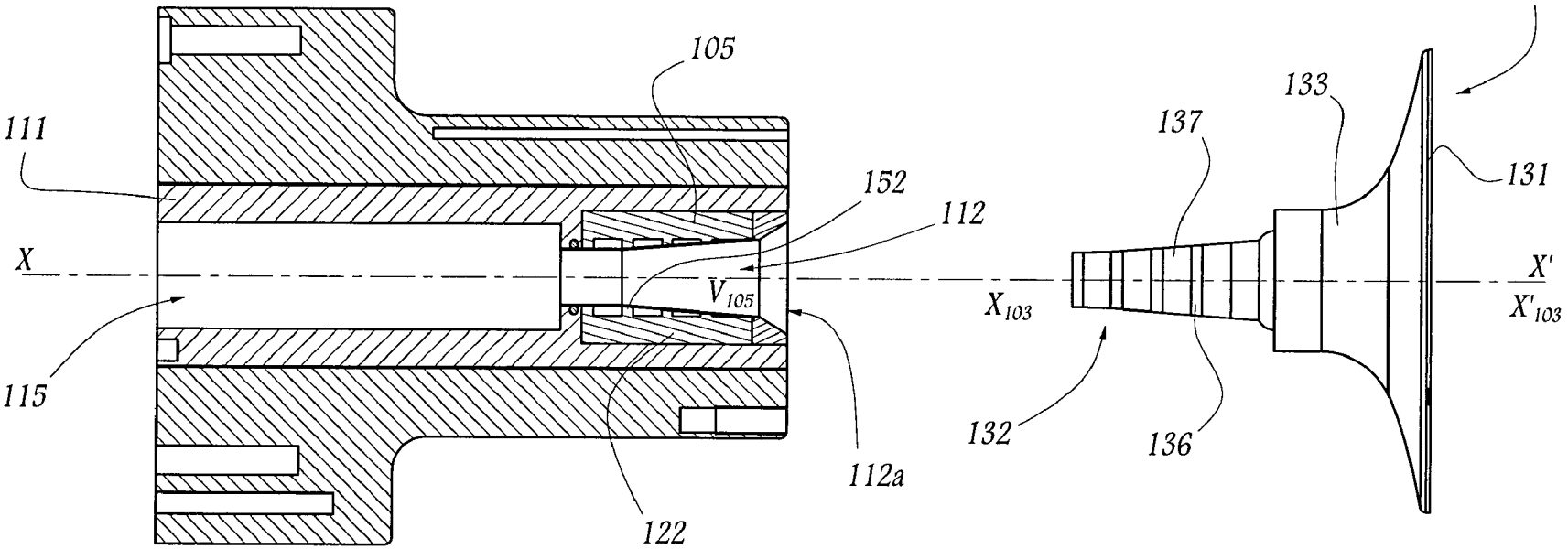
FIG. 5 is a view similar to FIG. 2 for a spraying device and a bowl in accordance with a second form of embodiment of the invention.

In the second form of embodiment of the invention shown in FIG. 5, elements similar to those of the first embodiment bear identical references increased by 100. The rotor 111 of this embodiment likewise forms a channel 115 for supplying coating products to a bowl 103 which comprises a hub 132 and a part 133 provided with a spraying edge 131. Magnets 137 are mounted around the hub 132 and are separated in twos by a magnetic body 136 constituted by ribs or rings connected on the hub 132. A cartridge 105 is mounted in a housing 112 formed at the opening of the channel 115 and comprises a magnetic ring provided with inner ribs or flanges 152 of which the thickness and spacing, taken parallel to the direction of the axis X–X' of rotation of the rotor 101, are respectively equal to the thickness and spacing of the bodies 136, taken parallel to the central axis $X_{103}$–$X'_{103}$ of the bowl 103.

This form of embodiment corresponds in practice to the first embodiment to which a reversal of structure between the part bearing the magnets, here the bowl 103, and the part equipped with ribs constituting the induced poles of magnetic coupling, here the rotor 111, has been applied.

As previously, the volume $V_{105}$ for receiving the hub 132 in the housing 112 is divergent in the direction of the opening 112*a* of this housing and the geometry of the surfaces respectively defining this volume and the outer envelope of the hub is chosen to allow a surface abutment of the hub in the cartridge.

Figure 6:
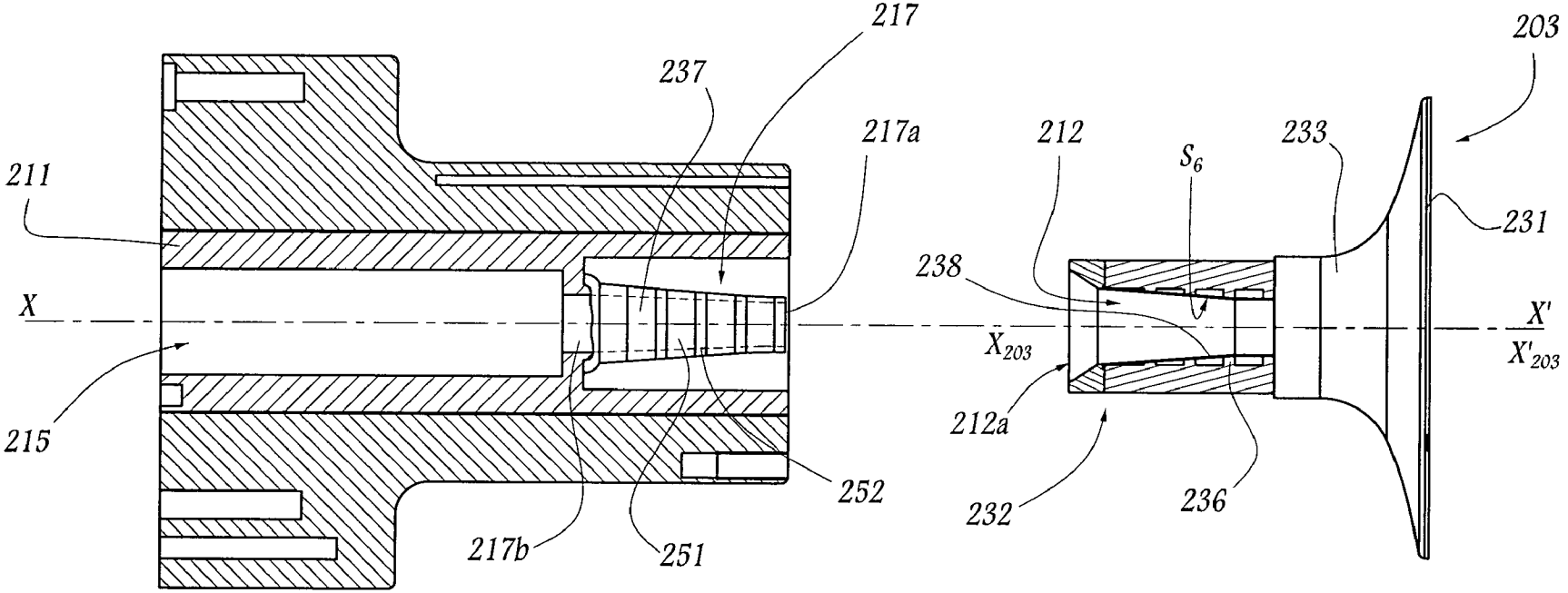
FIG. 6 is a view similar to FIG. 2 for a spraying device and a bowl in accordance with a third form of embodiment of the invention.

In the third form of embodiment of the invention shown in FIG. 6, elements similar to those of the first embodiment bear identical references increased by 200. The rotor 211 of this embodiment likewise forms a channel 215 for supplying coating product to a bowl 203 which comprises a hub 232 and a part 233 provided with a spraying edge 231. The rotor 211 is equipped with a hollow central shaft 217 on which are mounted magnets 251 separated by magnetic bodies 252 and at the centre of which the channel 215 extends in the form of a channel 217*b* of reduced diameter. This channel 217*b* makes it possible to supply the bowl 203 with coating and/or cleaning products.

The hub 232 forms a housing 212 for receiving the shaft 217 when the bowl 203 is mounted on the rotor 211.

$X_{203}$–$X'_{203}$ denotes the axis of symmetry of the bowl 203 and X–X' the axis of rotation of the rotor 211. These axes merge when the bowl 203 is mounted on the rotor 211.

The inner surface of the hub 232 is provided with ribs 236 which extend in the direction of the axis $X_{203}$–$X'_{203}$ and are intended to be approximately aligned with the bodies 252 in order to constitute the induced poles by the elements 251 and 252 when a magnetic coupling is obtained between the elements 211 and 203.

As previously, in that case, the effort of magnetic coupling obtained has a radial component with respect to the axis X–X'.

A tight, a magnetic partition 238 may be mounted in abutment on the ribs 236 and its inner surface $S_6$ is divergent in the direction of the opening 212*a* of the housing 212, while the outer surface of the magnets 251 and of the bodies 252 is convergent in the direction of the free end 217*a* of the shaft 217, this facilitating the mechanical centering of the elements 203 and 207 with respect to each other.

As previously, the thickness of the ribs 236 is chosen to be substantially equal to the thickness of the bodies 252 taken parallel to the axis X–X', their relative spacings likewise being substantially equal.

Figure 7:
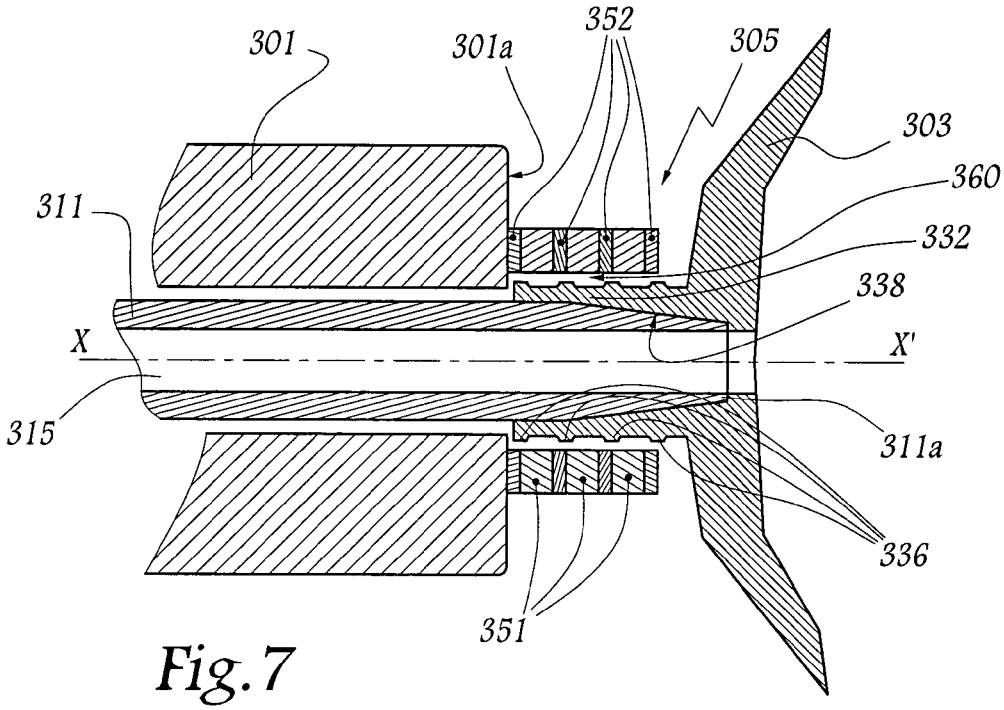
FIG. 7 is a longitudinal section of a device in accordance with a fourth form of embodiment of the invention.

In the fourth form of embodiment of the invention, shown in FIG. 7, elements similar to those of the first embodiment bear identical references increased by 300. The rotor 311 of this embodiment likewise forms a channel 315 for supplying a bowl 303 which comprises a hub 332 intended to be introduced in a housing 360 defined at the centre of an annular cartridge 305 fixed on the front face 301*a* of a casing 301 in which the rotor 311 can rotate about its central axis X–X'.

The cartridge 305 comprises three magnets 351 as well as four ferro-magnetic bodies 352 in the form of washers, these bodies 352 being intended to be approximately aligned with outer radial ribs 336 formed on the outer radial surface of the hub 332.

The magnets 351 and the washers 352 are circular and centered on the axis X–X'. The North and South polarities of the magnets 351 are opposite in twos, as in the preceding forms of embodiment.

The ribs 336 might also be added on the hub 332.

As in the preceding forms of embodiment, a magnetic effort is exerted between the elements 305 and 332, the lines of field tending to reclose through the elements 352 and 336. This effort has a radial component.

Furthermore, the hub 332 is hollow and provided with an inner radial surface 338 which is truncated and against which abuts the truncated front end 311*a* of the rotor 311, which allows the bowl 303 to fit on the rotor 311 in the manner of a Morse cone. Taking into account the geometry of the elements 311*a*, 338 and 336 and of the positioning of the elements 311 and 305 with respect to each other, the elements 336 and 352 are not quite aligned when the bowl is in mounted configuration, as shown in FIG. 7, with the result that the effort of magnetic coupling generated also has a component directed towards the left in FIG. 7, which tends to apply the bowl 303 firmly on the rotor 311.

In this configuration, an air gap which is cylindrical with circular base exists between the set of magnets 351 and the ribs 336.

It is easy to adjust the value of the effort of fixation of the bowl as a function of its size, its weight and its speed of rotation, by playing on the number of magnets of the cartridge 305. The particular advantages of this embodiment are the low mass of the rotating parts and the simplicity of production.

Figure 8:
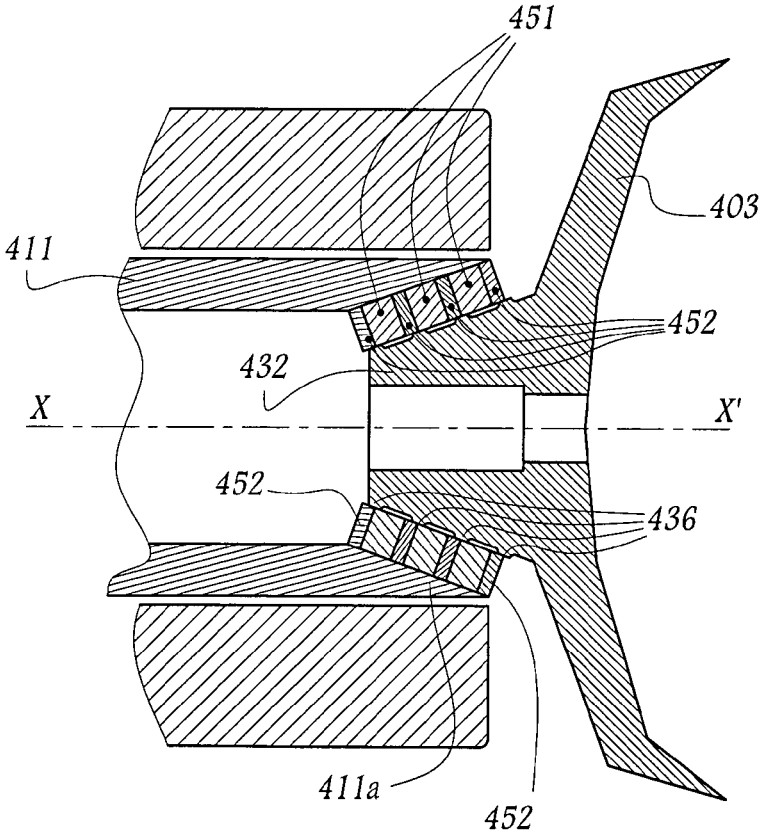
FIG. 8 is a section similar to FIG. 7 for a fifth form of embodiment of the invention.

In the fifth form of embodiment of the invention shown in FIG. 8, elements similar to those of the first embodiment bear identical references increased by 400. The magnets 451 and the magnetic bodies 452 are disposed with a truncated configuration. As for the bowl 403, it presents a hub 432 of which the outer surface is truncated and convergent towards the rear of the rotor 411, this surface being equipped with ribs 436 intended to be in alignment, at least approximately, with the bodies 452. The cooperation of the elements 451 and 452, on the one hand, and of the ribs 436, on the other hand, ensures both the magnetic fixation and the mechanical centering of the bowl in the front end 411*a* of the rotor 411 which is in the form of a shaft centered on its axis of rotation X–X'.

One advantage of this form of embodiment is that it makes it possible to obtain an effort of fixation calibrated in intensity by eliminating a possible effect of "magnetic catching" which the operator may not appreciate. The conicity of the magnets 451 is chosen to be sufficient for the successive air gaps to be greater than the distance of attraction, up to the mounted position of the bowl 403, the quality of the magnets and the precision of the assembly making it possible to define this conicity. This embodiment also presents the advantage of a good compactness in the direction of axis X–X' and of a possibility of pre-positioning of the bowl 403 in the front end 411*a* of the rotor 411 during its assembly.

According to a first variant of the invention (not shown), the relative spacing of the ribs 36 and equivalent may be chosen to be equal to a sub-multiple of the width $\mathbf{1}_{51}$ of the magnets 51, i.e. of the relative spacing of the magnetic bodies 52 and equivalent. In effect, an alignment of certain ribs 36 or equivalent with the bodies 52 and equivalent remains possible, certain other ribs in that case being located opposite the magnets 51. These other ribs are in that case not very functional for the desired magnetic coupling. This is applicable to all the forms of embodiment envisaged.

According to another variant of the invention (not shown), the spacing d may be equal to a multiple of the spacing d' of the bodies 52. In that case, certain bodies 52 are opposite an intermediate zone between two ribs 36 or equivalent. This may likewise be applied to all the forms of embodiment envisaged.

The invention has been shown with bowls 3, 103 or 203 in two parts. It is equally well applicable with a bowl of which the part distributing the product and the hub are in one piece. The representation of bowls 303 and 403 is very schematic.

The invention is applicable, independently of the exact nature of the product sprayed, liquid or pulverulent, hydrosoluble or not. The invention functions with sprayers which are electrostatic or not. The technical characteristics of the forms of embodiment described may be combined together within the framework of the present invention.

Whatever the form of embodiment in question, the magnetic elements, whether they be magnets or associated ribs, are, once the bowl is mounted on the rotor, located inside the housings 12, 112, 212, 360 or equivalent, which provides three additional advantages over a construction such as known by WO-A-01/162396, namely:

- a good axial compactness which is important as the axial dimension of a sprayer should be reduced as much as possible in order correctly to attain zones of an object to be coated of which the radius of curvature is small, such as the edges of automobile vehicle body doors. This makes it possible to improve the maneuverability of a robot and of a sprayer incorporating the invention and to reduce the resistant moment on the wrist.
- minimized losses of paint due to the axial compactness obtained for the sprayer. This also involves a lower consumption of rinsing products when the coating products are changed.
- an improved protection of the magnets against shocks, these magnets being fragile by construction.

The invention is applicable, independently of the exact number of magnet(s) and of rib(s) used, the number of ribs being, in practice, adapted to the number of magnets.

What is claimed is:

1. Spraying bowl for a rotary sprayer projecting coating product, said bowl being equipped with means for magnetic coupling with a member for driving in rotation or with a casing surrounding said member, wherein said magnetic coupling means are adapted to cooperate with complementary means borne by said member or said casing, in that said magnetic coupling means are radially offset from said complementary means, with respect to the axis of rotation of said bowl, in such a manner that the magnetic coupling effort obtained has a radial component with respect to the axis of rotation of said bowl.

2. The bowl of claim 1, wherein said magnetic coupling means comprise at least one magnetic element which is either disposed around a male part of said bowl adapted to be engaged in a central housing of said member or of said casing, or disposed inside a female part of said bowl forming a housing for receiving a central shaft fast with said member.

3. The bowl of claim 2, wherein said magnetic elements form radial flanges which extend either towards the outside from said male part or towards the geometrical axis of rotation of said bowl from said female part.

4. The bowl of claim 2, wherein permanent magnets are disposed between each pair of adjacent magnetic elements.

5. The bowl of claim 2, wherein it presents no magnets.

6. The bowl of claim 2, wherein said magnetic elements are inscribed in an enveloping surface convergent in the direction of the free end of said male part or divergent in the direction of the opening of the housing of said female part.

7. The bowl of claim 2, wherein said male part is hollow and forms a channel for supplying coating product for a spraying surface and/or edge of said bowl.

8. The bowl of claim 1, wherein means are provided for fitting on said member, said magnetic coupling means being disposed around said fitting means and adapted to cooperate with complementary means not driven in rotation by said member, in order to contribute to an effort of fit of said bowl on said member.

9. Device for spraying coating product comprising a bowl and a member adapted to drive said bowl in rotation, means for magnetic coupling between said bowl and said member or between said bowl and a casing surrounding said member being provided and including at least one permanent magnet and complementary means, wherein said complementary means are radially offset from said at least one permanent magnet, with respect to the axis of rotation of said bowl, so that the effort of magnetic coupling has a radial component with respect to the axis of rotation of said bowl.

10. The device of claim 9, wherein said complementary means further comprise at least one magnetic body associated with said magnet, and mounted on one of the two elements constituted by said bowl and said member or said bowl and said casing, while the other element bears at least one rib formed of a magnetic material.

11. The device of claim 10, wherein the thickness of said rib or ribs is substantially equal to the thickness of said body or bodies.

12. The device of claim 10, wherein it comprises a plurality of magnetic bodies and a plurality of ribs, and the relative spacing of said ribs is substantially equal to, or corresponds substantially to a multiple or a sub-multiple, of the relative spacing of said bodies.

13. The device of claim 10, wherein said bowl is provided with a male part around which said ribs or said bodies is/are disposed, while said drive member is provided with a central housing for receiving said male part, magnetic coupling elements, complementary of those borne by said bowl, being provided in said housing, around said male part.

14. The device of claim 13, wherein said magnet or magnets and the associated magnetic bodies are grouped together in the form of a cartridge disposed in said housing, while said ribs are provided around said male part.

15. The device of claim 13, wherein the volume for reception of said male part in said housing is defined by a surface of revolution centered on the axis of rotation of said drive member and divergent in the direction of the opening of said housing, while said ribs or said bodies borne by said male part are inscribed in an enveloping surface which has substantially the same geometry as that defining said volume and which is convergent in the direction of the free end of said male part.

16. The device of claim 10, wherein said bowl is provided with a female part inside which said ribs is/are formed, while said drive member is provided with a central shaft adapted to be engaged in a housing formed in said female part, magnetic coupling elements complementary of those borne by said bowl being mounted on said shaft.

17. The device of claim 16, wherein the housing formed in said female part for receiving said shaft is defined by a surface of revolution centered on a central axis of said bowl and divergent in the direction of the opening of said housing, while said bodies or said ribs borne by said shaft are inscribed in an enveloping surface which has substantially the same geometry as that defining said housing and which is convergent in the direction of the free end of said shaft.

18. The device of claim 9, wherein said bowl is provided with a male part adapted to be inserted in a housing defined by a casing surrounding said drive member, said male part itself being equipped with means for fitting on said member.

19. The device of claim 18, wherein said fitting means comprise a truncated bearing surface of shape substantially complementary of that of the end of said member.

20. The device of claim 9, wherein said drive member is provided with a central channel for supplying coating product, while said bowl is provided with a central channel for supplying coating product for a discharge surface and/or edge, said channels being connected to each other when said bowl is magnetically coupled to said member or to said casing, the magnetic coupling occurring around one of said channels.

21. The device of claim 9, wherein relief elements for gearing are provided on said bowl and on said member.

22. Installation for spraying coating product, wherein it comprises at least one spraying device according to claim 9.

* * * * *